US006041572A

United States Patent [19]

Gandini

[11] Patent Number: 6,041,572

[45] Date of Patent: Mar. 28, 2000

[54] PACKAGE FOR THE CARRYING OF PIECES IN PAIRS, IN PARTICULAR FOR THE CARRYING OF BOTTLES, AND RELEVANT MANUFACTURING METHOD

[75] Inventor: Luciano Gandini, Podenzano, Italy

[73] Assignee: Twin Pack S. r. l., Podenzano, Italy

[21] Appl. No.: 09/065,561

[22] Filed: Apr. 24, 1998

[51] Int. Cl.[7] ..... B65B 13/02

[52] U.S. Cl. ..... 53/399; 53/586; 206/428

[58] Field of Search ..... 206/427, 442, 206/460, 813, 428, 434, 162, 170, 150; 53/399, 586, 228, 466; 40/630, 638

[56] References Cited

U.S. PATENT DOCUMENTS

| | | | |
|---|---|---|---|
| 2,516,292 | 7/1950 | Bennett | 40/638 |
| 2,810,476 | 10/1957 | Guyer | 206/427 |
| 3,987,901 | 10/1976 | Dullinger | 206/460 |
| 4,296,861 | 10/1981 | Barrash | 206/428 |
| 4,880,115 | 11/1989 | Chaussadas | 206/427 |
| 4,930,633 | 6/1990 | Gloyer | 206/427 |
| 5,570,787 | 11/1996 | Danovaro et al. | 206/427 |
| 5,645,300 | 7/1997 | Hill | 40/638 |

*Primary Examiner*—Paul T. Sewell
*Assistant Examiner*—Luan K. Bui
*Attorney, Agent, or Firm*—Young & Thompson

[57] ABSTRACT

A package of two or more grouped items, in particular bottles, of the type comprising an adhesive band wrapped around the products in order to group them together. The adhesive band is made of two adhesive strips applied to the items at opposite sides thereof. The length of the strips is more than the length of the half-perimeter of the group of items, so that the strips overlie each other at opposite ends of the strips.

1 Claim, 3 Drawing Sheets

PACKAGE FOR THE CARRYING OF PIECES IN PAIRS, IN PARTICULAR FOR THE CARRYING OF BOTTLES, AND RELEVANT MANUFACTURING METHOD

The present invention proposes a package for the carrying of pieces in pairs, in particular for the carrying of bottles, comprising an adhesive band wrapped around the body of the bottles and an adhesive tape stuck on said strip, which is the handle.

The invention is characterized by the fact that said band is made of two adhesive strips that are both applied to the body of the bottles, at opposite sides thereof, and by the fact that the ends of said adhesive strips overlap to a certain length.

The invention also relates to a method for the manufacturing of said package comprising:

Advancing the bottles, gathered together, on a belt conveyor;

Feeding two adhesive strips, from reels placed at opposite side with respect to of said belt conveyor, to bring their ends to interfere with the path of the bottles;

stopping the advancing of said strips when their ends overlap to a certain length;

tightening said strips on the back part of the bottles after that said bottles, while advancing, have engaged front ends of said strips;

cutting said strips and applying a handle thereto.

The method and the package according to the invention have several advantages with respect to the known packages, as they improve the possibility for the bottles of being worked with a machine, so allowing to work the wet bottles too without any problem, the latter thing being not possible with the traditional systems.

The invention belongs to the field of packing, in particular to the field of the bottle packing in which the supermarkets, self-services, etc., often require packing that allows the client to take several bottles together from a shelf and also to carry them easily.

Among the several kind of packages, boxes, cardboard boxes, packages made of shrink material, and so on that group a certain number of bottles together, in the latter years packages have been known, made of a band of adhesive strip which is wrapped around two or more bottles so as to keep them together, with an adhesive tape acting as a handle, applied to said strip.

According to the state of the art, most of these packages are made of a tubular band, obtained by soldering at the edges a plastic strip which is applied to the bottles thanks to the elastic deformation of the material of which it is composed.

A strip of adhesive tape is then applied to said annular elastic band in order to obtain the handle that allows the handy carrying of the package. This system requires machines quite complex and expensive to apply the strip to the bottles, then one needs a separate soldering apparatus for the production of the tubular strip from a plain strip and it has the inconvenience that the product is difficult to be machine worked.

WO 96/24535 relates to a banding tape and method, comprising two strips, one of which is made of elastic polymeric material.

A strip may be wrapped around a number of items, and the second strip is then applied to the first one, to fasten it.

FR 2252265 shows a package made of two strips which have their ends adhesive and that are wrapped around an item with their adhesive ends facing one another.

FR 2590544 shows a package made of a strip that is wrapped around the items with its that overlap. A handle is then applied.

DE 9117210 U1 shows a package made by advancing a series of items to engage a plastic band.

This band is then wound around the items and joined at the opposite side, as shown in FIG. 4 of the patent.

Another kind of known package for bottles is obtained by applying at the opposite sides of the bottles, strips of adhesive tape in order to gather them.

These strips, cut to the required length, extend from a bottle at the sides of the final package, and they are not as long as the half-perimeter of the package itself.

For a better understanding, reference is made to FIG. 1 which schematically shows, in a plan view, a package of two bottles obtained by the known system.

In this figure, letter B indicates the bottles.

The adhesive strips are indicated with A' and A" and wrap all around the bottles at one side, but they leave a part of the bottles uncovered at their adjacent ends, this part being indicated with P in FIG. 1.

The known package machines apply two opposing strips of adhesive tape to the bottles, these strips being of limited length, so as not to overlap. This involves several difficulties, since the adhesive strips are applied at the sides of the bottles and, if these last are not completely dry, the strips do not meet a surface on which the glue can catch, with the related inconveniences, i.e. the failure of the package formation, risk of machine jam, etc.

To avoid the above mentioned inconveniences and limitations, the present invention proposes a package, and the relevant method, for the carrying of joined pieces, e.g. pairs of bottles, package that is obtained by the applying two strips to the bottles, said strips overlapping to a certain length at their ends thus ensuring a safe catch even when the bottles are wet, as it will be apparent from the following description.

We want to specify that in this text the term "pieces in pairs" refers to two or more pieces, in particular bottles, grouped together and that, even if the following description refers to packages each comprising two bottles, the same solution will be applied when the bottles are three or more or when the products are different in different bottles.

The present invention will now be described in details, as a not limitative example, with reference to the enclosed drawings in which: FIG. 1 shows a plan view of a package of two bottles obtained by a known system;

the FIGS. 4 to 7 show schematically the different phases of the production cycle of the packages according to the invention.

Figure 2:
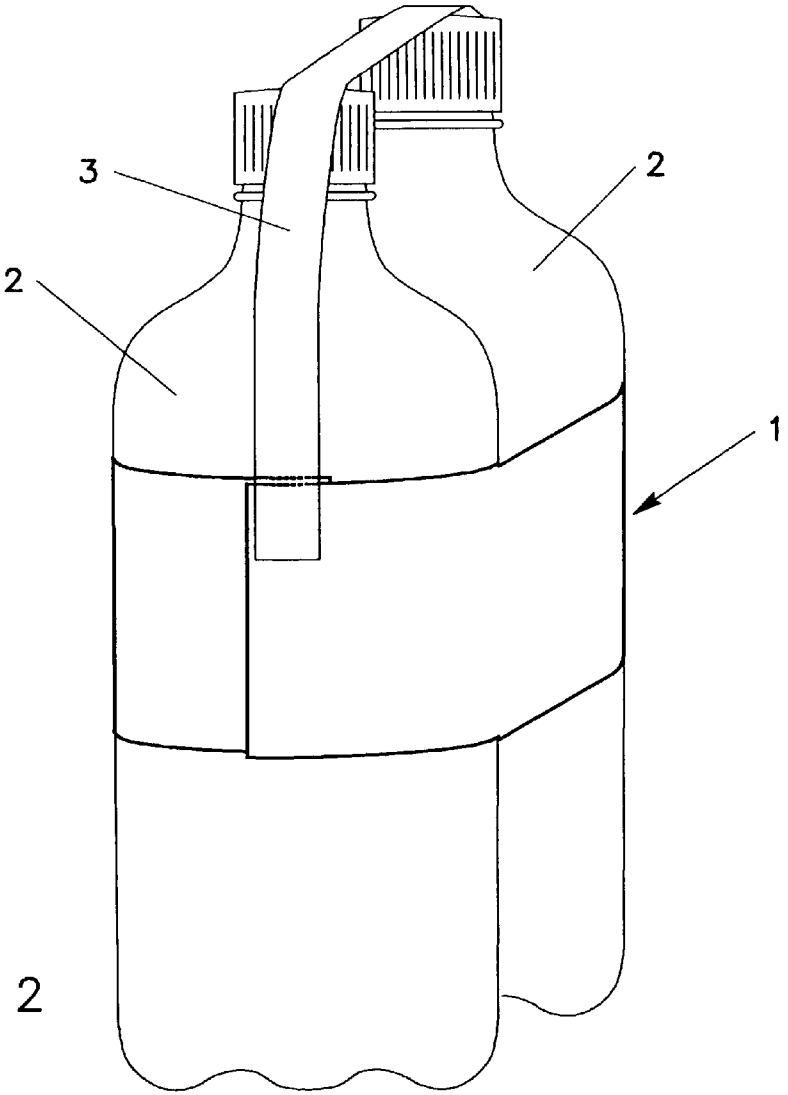
FIG. 2 shows the perspective view of a pair of bottles packed with the method and the package of the invention.
Figure 1:
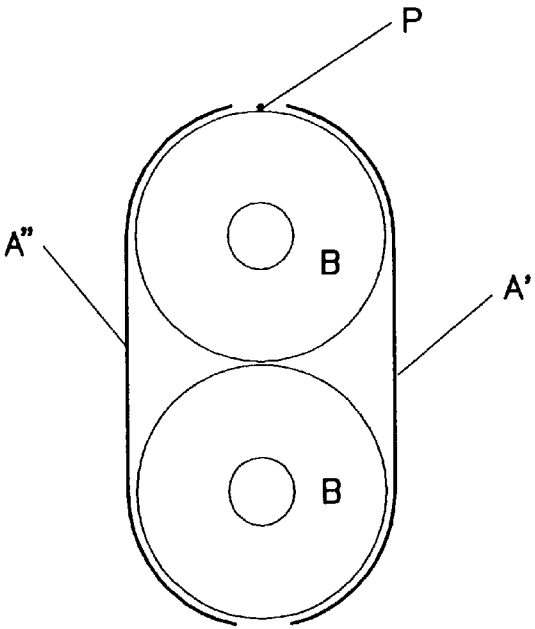
FIG. 1 (PRIOR ART)

With reference to FIG. 2, number 1 indicates the package comprising a pair of bottles 2, and which is made of two strips of plastic adhesive material, wrapped around the bottles, and of a tape 3 having its ends adhesive.

This tape, which is applied to the strip 1, is the handle.

Figure 3:
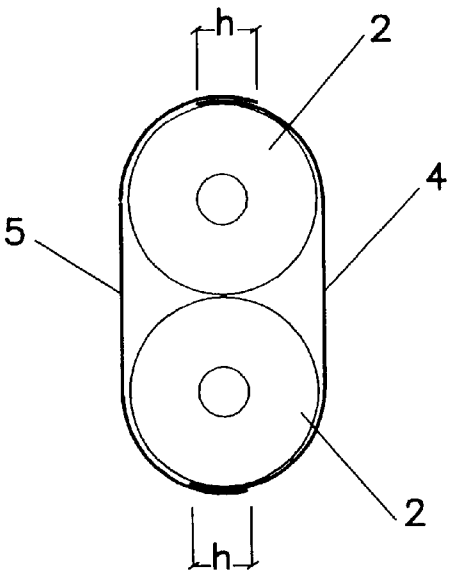
FIG. 3 shows schematically the plan view of the same package.
Figure 7:
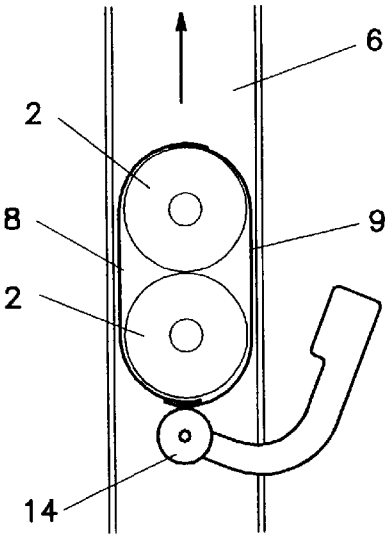

This band 1, as told before, is made of two adhesive opposite strips, indicated with numbers 4 and 5 in FIG. 3, which are wrapped around the bottles and overlap to a certain length, indicated by the letter "h".

This overlap is very important, since it allows the strips 4 and 5 to meet always a dry surface, which corresponds to the length of "h" of the other strip, allowing thus the glue to obtain a safe catch.

To obtain this package one may proceed as is schematically indicated in FIGS. from 4 to 7.

Figure 4:
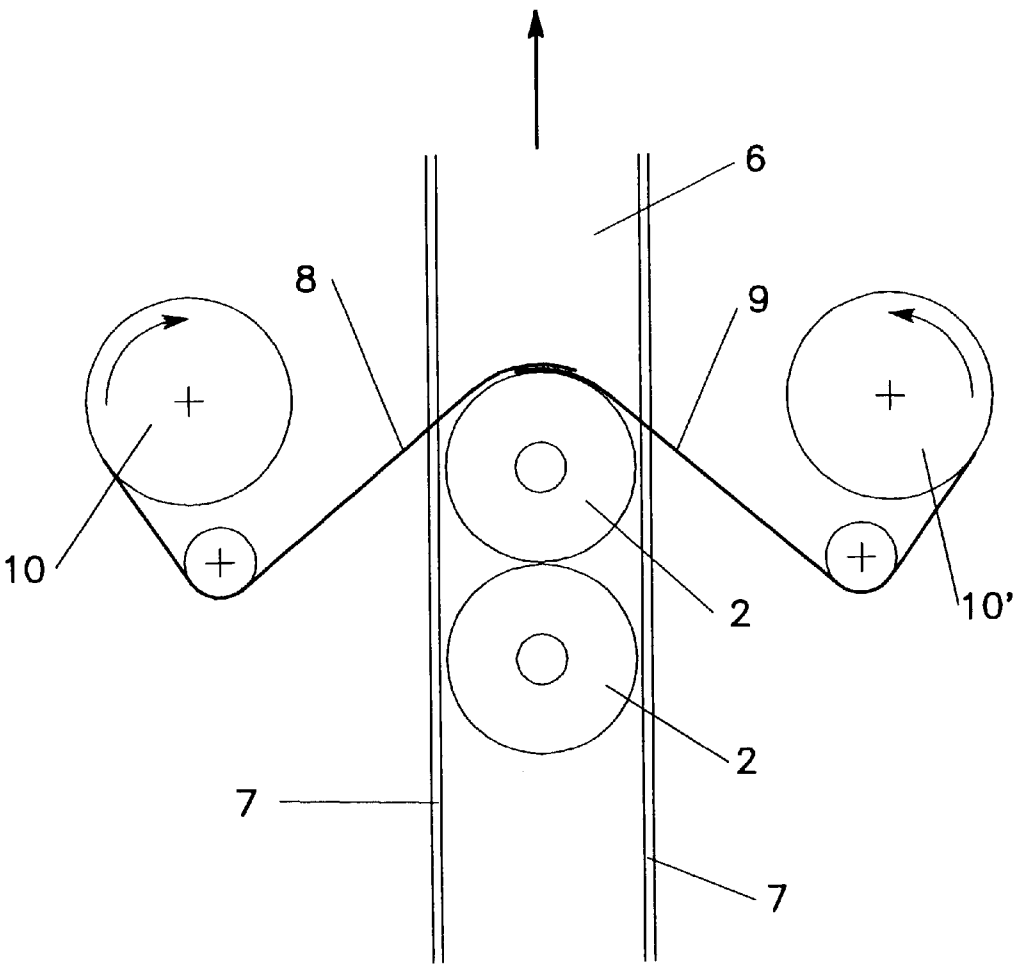

With reference to FIG. 4, the bottles 2, in pairs, are brought by a conveyor belt 6 provided with lateral guides 7, to the packing zone where two strips of adhesive tape, 8 and 9, taken from two bobbins 10 and 10' placed at opposite sides of the conveyor 6, are fed by apparatuses of the known type, that push them to engage the bottles 2.

The adhesive surface of the bands 8 and 9 is turned to the direction where the bottles come from.

A characteristic of the invention is the fact that the bands 8 and 9 are advanced till their ends overlap to a length "h", for example to a 10–20 mm length.

The bottles 2, while advancing along the conveyor 6, engage the first of the two strips— in the drawing the strip 9— and push it against the second strip, allowing the two overlapped length of the strips to adhere.

Figure 6:
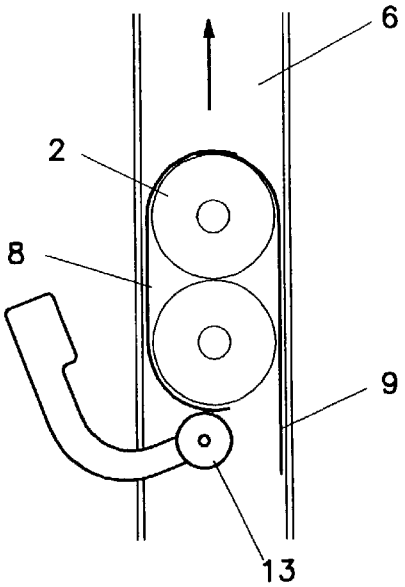
Figure 5:
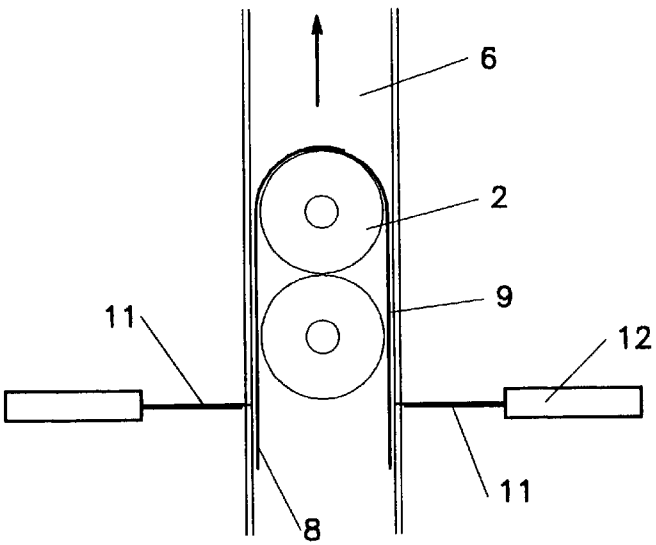

Now the two strips 8 and 9 cannot slide along the bottles even if these are wet, so they are engaged by the front part of the first bottle and dragged as shown in FIG. 6.

They are then pushed against the bottles without any possibility of moving, even if the bottles are wet. After that the bottles are advanced of a sufficient length, a pair of cutters 11, moved e.g. by plungers or the like (FIG. 5) cut the strips 8 and 9 at the required length, to ensure a certain overlap of the two strips also in the rear part of the bottles.

Downstream the cutters 1, a pair of staggered rolls 13 and 14, preferably covered with soft material as sponge or the like, engage in sequence the two cut strips 8 and 9, bending them around the body of the bottles to obtain the embodiment shown in FIG. 3.

The package now can be completed by the application of the adhesive tape 3 in order to obtain a handle and sent to the storage.

The devices which are part of the machine, as the cutters, the tightening rolls, etc. are of the known type and a detailed description is not necessary; a technician of the field could build the machine without further tests.

Therefore the method according to the invention, as shown, comprises several phases:

placing the items to be packed, on a conveyor;

feeding two adhesive strips, coming from reels placed at opposite sides with respect to said belt conveyor and having their adhesive surfaces directed towards the incoming bottles, to bring said adhesive strips to interfere with the path of the bottles;

advancing said strips until their ends overlap to a certain length;

advancing the bottles until they engage said tapes making them to adhere one to the other;

cutting said adhesive tapes to obtain a pair of strips long enough to allow an overlap of the same at the rear part of the bottles too;

making one of said strips to adhere to the bottles by means of pressing devices;

making the other strip to adhere to the bottles by means of second pressing devices, so that said second strip will overlap the first strip by a certain length at the rear part of the bottles;

applying an adhesive strip used as a handle.

It is then clear that the method according to the invention allows to work without problems even with wet bottles and it may be performed by using easy and low-cost machines and also allows the quick packaging of items as big as wanted, without the use of particular devices or packages.

I claim:

1. A method for producing a package of at least two grouped items, comprising advancing said items grouped together along a feed path, and opposing in said path two adhesive tapes from opposite sides of said path so that an advancing item contacts overlapping ends of said strips with adhesive between one said end and said item and also between said ends, cutting said strips to a predetermined length, and tightening said strips on a rear part of said items while said items are moving along said path, said predetermined length being such that when said strips are tightened against said items, rear ends of said strips opposite the first mentioned ends of said strips will overlie each other and a rearmost said item with adhesive on said strips being disposed between one rear strip end and said rearmost item and between said rear ends.

* * * * *